US007780205B2

(12) United States Patent
Graute

(10) Patent No.: US 7,780,205 B2
(45) **Date of Patent: *Aug. 24, 2010**

(54) MOTOR VEHICLE DOOR LOCK

(75) Inventor: Ludger Graute, Essen (DE)

(73) Assignee: Kiekert AG, Heiligenhaus (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/193,714

(22) Filed: Aug. 18, 2008

(65) Prior Publication Data

US 2008/0303292 A1 Dec. 11, 2008

Related U.S. Application Data

(63) Continuation-in-part of application No. 10/555,378, filed on Nov. 2, 2005, now Pat. No. 7,509,598.

(30) Foreign Application Priority Data

May 8, 2003 (DE) ..... 103 20 459

(51) Int. Cl.
*E05C 3/06* (2006.01)

(52) U.S. Cl. ..... 292/216; 292/201

(58) Field of Classification Search ..... 292/216, 292/201, DIG. 23

See application file for complete search history.

(56) References Cited

U.S. PATENT DOCUMENTS

| | | | | |
|---|---|---|---|---|
| 4,073,519 | A | 2/1978 | Kurozu et al. | |
| 4,358,141 | A | 11/1982 | Hamada | |
| 4,756,564 | A | 7/1988 | Ikeda | |
| 4,783,103 | A * | 11/1988 | Schlegel | 292/216 |
| 4,854,617 | A | 8/1989 | Hayakawa et al. | |
| 5,020,838 | A | 6/1991 | Fukumoto | |
| 5,348,357 | A | 9/1994 | Konchan et al. | |
| 6,631,930 | B2 | 10/2003 | Haglund | |
| 6,749,234 | B2 | 6/2004 | Bruce | |
| 6,789,825 | B2 * | 9/2004 | Kalargeros et al. | 292/216 |
| 6,811,193 | B2 | 11/2004 | Arabia, Jr. et al. | |
| 7,188,872 | B2 | 3/2007 | Kalargeros et al. | |
| 7,195,292 | B2 | 3/2007 | Ketelsen et al. | |
| 2006/0279090 | A1 | 12/2006 | Ottino et al. | |

FOREIGN PATENT DOCUMENTS

| | | |
|---|---|---|
| EP | 0 808 978 A2 | 11/1997 |
| EP | 0 995 870 A1 | 4/2000 |
| EP | 1 126 108 A1 | 8/2001 |
| GB | 2 284 231 A | 5/1995 |

* cited by examiner

*Primary Examiner*—Peter M Cuomo
*Assistant Examiner*—Kristina R Fulton
(74) *Attorney, Agent, or Firm*—Matthias Scholl, PC; Matthias Scholl

(57) ABSTRACT

A vehicle door latch comprising a catch, the catch having a main catch surface; a reset spring for resetting the catch; a cushioning stop mounted on the catch for rotation therewith and for providing a point of attachment for the reset spring; a cushioning element for cushioning the catch; and a latch housing having a receiving groove; wherein the cushioning element is disposed in the receiving groove; the cushioning element is stacked above the main catch surface; the cushioning stop limits opening movement of the catch by engaging against the cushioning element; and the reset spring is connected to the cushioning stop.

25 Claims, 2 Drawing Sheets

MOTOR VEHICLE DOOR LOCK

CROSS-REFERENCE TO RELATED APPLICATIONS

This is a continuation-in-part application of U.S. Ser. No. 10/555,378, now pending, which is a National Phase Application of International Patent Application PCT/DE2004/000918, and further claims priority to German Patent Application No. 103 20 459.8, filed May 8, 2003. The contents of all of these specifications are incorporated herein by reference.

BACKGROUND OF THE INVENTION

1. Field of the Invention

The invention refers to vehicle door latch with at least one locking mechanism containing a catch, acted upon by a reset spring and a pawl and an inlet opening as well as a locking pin cooperating with the catch.

2. Description of Related Art

Typically, motor vehicles include door locks. For locking the vehicle doors, a locking pin located on the vehicle body moves into the inlet opening of vehicle door latch and is held tight by a catch. Such a vehicle door latch is known in which the inlet opening contains a cushioning element, which ensures that the locking pin moving into the inlet opening and then held in its primary position by the catch, is fixed in this position with less noise (See e.g. EP 0 336 034 A2). Irrespective of this, a reset spring acts upon the catch to turn the catch from its closed position back into its open position after disengagement of the pawl assigned to it, when the vehicle door is being opened or is open. For this reset spring, a spring stop is molded on the catch. This is costly from a material and production point of view. The invention aims to solve this problem.

BRIEF SUMMARY OF THE INVENTION

The invention described herein provides a vehicle door latch with at least one locking mechanism (2, 3) containing a catch (2) being acted upon by a reset spring (1) and a pawl (3) and with an inlet opening (5) as well as a locking pin (6), cooperating with the catch (2), characterized in that the catch (2) contains a cushioning stop (7) and that the cushioning stop (7) is designed as a spring stop (7*a*) for the reset spring (1) on its non-cushioning side.

In certain embodiments of the invention described herein, the catch (2) is encased with soundproofing material, such as thermoplastic plastic such as polyurethane and that the cushioning stop (7) and spring stop (7*a*) are part of the casing (9).

In certain embodiments of the invention described herein, the cushioning stop (7) is designed as a stop rib arranged in the area around the catch.

In certain embodiments of the invention described herein, the stop rib (7) contains a pocket-like recess (10).

In certain embodiments of the invention described herein, the stop rib (7) contains a stop face (7*b*) at one end and a spring connection (11), such as a connection projection, at its other end.

In certain embodiments of the invention, a vehicle door latch comprises a catch, the catch having a main catch surface; a reset spring for resetting the catch; a cushioning stop mounted on the catch for rotation therewith and for providing a point of attachment for the reset spring; a cushioning element for cushioning the catch; and a latch housing having a receiving groove.

In certain embodiments of the invention, the cushioning element is disposed in the receiving groove.

In certain embodiments of the invention, the cushioning element is stacked above the main catch surface.

In certain embodiments of the invention, the cushioning element projects above the main catch surface and partially-overlaps with the catch.

In certain embodiments of the invention, the cushioning stop is mounted on the main catch surface and projects above the main catch surface.

In certain embodiments of the invention, the cushioning stop limits opening movement of the catch by engaging against the cushioning element.

In certain embodiments of the invention, the reset spring is connected to the cushioning stop.

In certain embodiments of the invention, the cushioning stop comprises further a pocket-like recess.

In certain embodiments of the invention, the door latch comprises further a stop, the stop being disposed on the latch housing, and the second stop limiting overtravel of the catch.

In certain embodiments of the invention, the cushioning element is reinforced.

In certain embodiments of the invention, the cushioning stop (7) is made from soundproofing material, such as polyurethane.

In certain embodiments of the invention, the reset spring is wound around an axis of rotation of the catch.

In certain embodiments of the invention, the catch is shaped substantially as a disc having a recess for receiving a locking pin, and the cushioning stop is mounted on the disc substantially opposite the recess with respect to the disc.

BRIEF DESCRIPTION OF THE DRAWINGS

Below, the invention is explained in detail with reference to a drawing representing only one embodiment of the invention, in which.

DETAILED DESCRIPTION OF THE INVENTION

Figure 1:
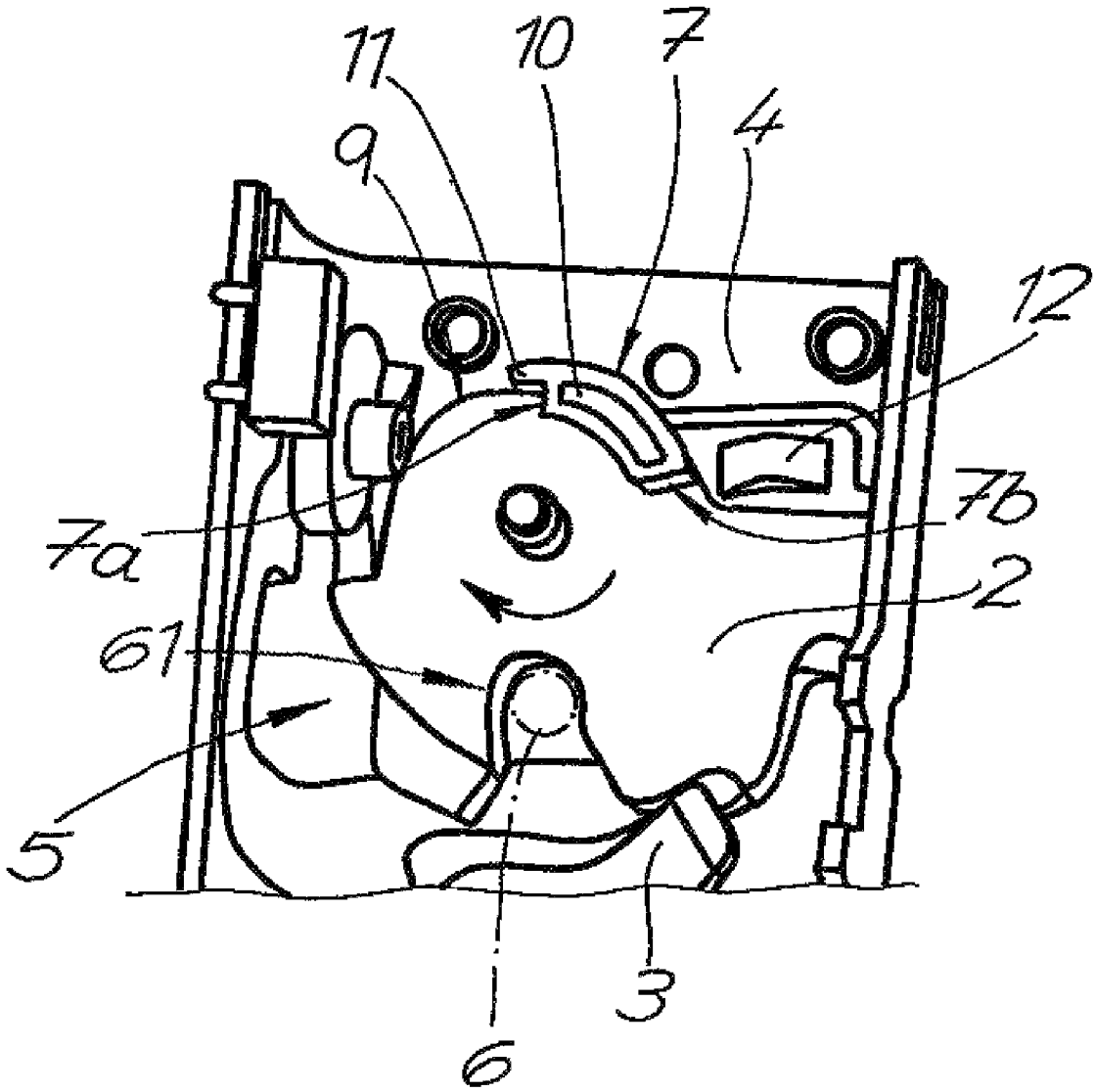
FIG. 1 shows a vehicle door latch of the invention with top view onto a back plate with a locking mechanism, without a reset spring and with a cushioning stop for the catch, and FIG. 2 an enlarged excerpt from the object of FIG. 1 including reset spring and cushioning stop for the catch.

The invention has the task of providing a vehicle door latch of the type described above, in which the catch operates quietly and offers a simpler construction.

The invention solves the task in a vehicle door latch of the described type by the catch containing a cushioning stop and this cushioning stop on its non-cushioning side also being designed as a spring stop for the reset spring.

The invention is based on the knowledge that in case of a vehicle door latch, a considerable noise reduction as part of, in particular, the opening process, can be achieved if not only a cushioning element for the locking pin of the assigned vehicle door, but also a cushioning stop for the catch is provided. The cushioning stop for the catch can, at the same time, cooperate with the cushioning element for the locking pin. Such a cushioning stop can, at the same time, also be designed as a spring stop for the reset spring, so that a separate spring stop, molded on the catch, is no longer required. In this way a, from a production and technical point of view, simpler construction is achieved, saving on material and mass.

According to a preferred embodiment of the invention, the catch is encased in a soundproofing material, such as plastic or polyurethane or similar, with the cushioning and spring stop forming a part of this casing. Such a plastic casing with cushioning and spring stop is relatively easy to produce and relatively light, so that in this way the above mass reduction can be achieved, which is of considerable importance for moving parts.

Other measures of the invention are listed below. According to the invention, the cushioning stop is, for instance, designed as a stop rib arranged around the edge of the catch, following the perimeter of the catch over a specified partial section. For this purpose, the stop rib contains a pocket-like recess and consequently also operates like a buffer, so that an increased cushioning effect is achieved. The stop rib also contains an uncovered stop face at one end and a spring connection for the reset spring at the other end, such as a connection projection for the legs of a reset spring, designed as a leg spring.

The figures show a vehicle door latch with at least one locking mechanism, containing a catch 2 acted upon by a reset spring 1 and a pawl 3 cooperating with catch 2 in a back plate 4, and a locking pin 6 moving into an inlet opening 5 and cooperating with the catch 2 in a respective vehicle door that is only indicated. The reset spring 1 acts upon the catch 2 in the opening sense and consequently in clockwise direction, indicated by an arrow. The pawl 3 can be activated mechanically, by a lever mechanism—not shown—or also by means of a motor, in particular an electric motor.

The catch 2 contains a cushioning stop 7, moving in the opened position (clockwise in FIG. 2) against a buffer-like cushioning element 8. This cushioning element 8 is located in the back plate 4. The cushioning stop 7 on the catch 2 is designed as a spring stop 7*a* for the reset spring 1 on its non-cushioning side. The catch 2 and, where applicable, also the pawl 3, to some extent, are encased with a soundproofing material such as plastic or polyurethane, with the cushioning stop 7 and the spring stop 7*a* being part of the casing 9. The cushioning stop 7 is designed as a stop rib, arranged around the edge of the catch and following the periphery of the catch 2 over a partial section. This stop rib 7 contains a pocket-like recess 10 and is therefore also characterized by its own buffering effect. The stop rib 7 contains a simple stop face 7*b* at its cushioning end and a spring connection 11, such as a connection projection for the reset spring 1, designed for instance as a leg spring, at its other end. All in all, a locking mechanism low in friction and noise is provided, which is characterized by its simple and its well functioning construction.

FIG. 1 also shows a stop 12 in the back plate or latch housing, which limits or restricts an overtravel of catch 2. The cushioning stop 7 serves, on the other hand, for stopping or limiting the opening movement of the catch 2. The cushioning stop 7 can also be equipped with one or several reinforcement ribs.

Figure 2:
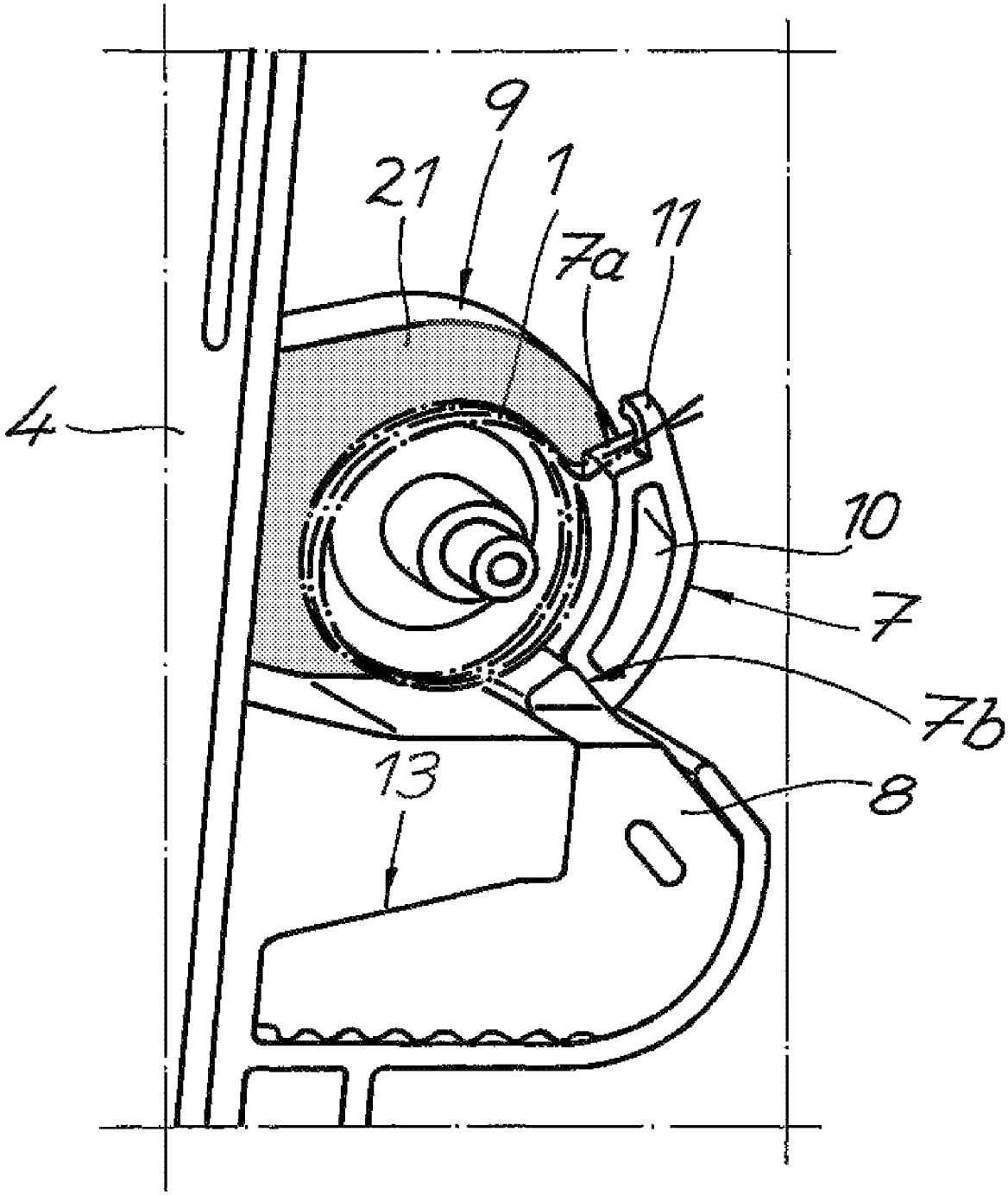

As outlined briefly above, and as illustrated in FIG. 2, the cushioning stop 7 is located in such a way on the catch 2, and particularly on the main catch surface 21 of the catch 2, so that it can carry out the dual function of (1) cushioning the catch 2 by engaging in a fully-open position (shown in FIG. 2) against the cushioning element 8 and at the same time (2) providing an attachment point for the reset spring 1. To save horizontal space within the housing 4, the cushioning element 8 is located above the catch 2, and particularly above the main catch surface 21, in a receiving groove 13. Therefore, the cushioning stop 7 is also mounted above the catch 2, on the main catch surface 21, as shown in FIG. 2. This mutual arrangement of the cushioning stop 7 with respect to the cushioning element 8, saves space, assures sturdiness and reliability of design and allows for the two components to engage against each other when the catch is fully opened by the action of the reset spring 1. In addition, due to the necessity of being disposed in the proximity of the reset spring 1, which is wound about the axis of rotation of catch 2, the cushioning stop 7 is located on the edge of the catch 2 in such a way that the distance between the attachment point 11 and the windings of the spring around the axis of rotation of catch 2 is minimized. A most preferable location for the cushioning stop 7 is opposite to the recess 61 of the catch 2 for receiving the locking pin 6. This solution completely eliminates the need for a separate spring stop molded on the catch 2, lowers cost and, reduces failure.

This invention is not to be limited to the specific embodiments disclosed herein and modifications for various applications and other embodiments are intended to be included within the scope of the appended claims. While this invention has been described in connection with particular examples thereof, the true scope of the invention should not be so limited since other modifications will become apparent to the skilled practitioner upon a study of the drawings, specification, and the following claims.

All publications and patent applications mentioned in this specification are indicative of the level of skill of those skilled in the art to which this invention pertains. All publications and patent applications mentioned in this specification are herein incorporated by reference to the same extent as if each individual publication or patent application mentioned in this specification was specifically and individually indicated to be incorporated by reference.

What is claimed is:

1. A vehicle door latch comprising:

a catch (2), said catch (2) having a main catch surface (21);

a pawl (3) cooperating with said catch (2);

a reset spring (1) for resetting said catch (2);

a cushioning stop (7) mounted on a partial section of the periphery of said catch (2) for rotation therewith; the cushioning stop having a cushioning side and non-cushioning side; the non-cushioning side providing a point of attachment for said reset spring (1); a cushioning element (8) for cushioning said catch (2); and a latch housing (4) having a receiving groove (13);

wherein said cushioning element (8) is disposed in said receiving groove (13);

said cushioning element (8) is stacked relative to said main catch surface (21); said cushioning stop (7) limits opening movement of said catch (2) from a closed position to an open position by engaging against said cushioning element (8);

and one end of said reset spring is directly connected to said cushioning stop (7) at the periphery of the catch at the attachment point.

2. The vehicle door latch of claim 1, wherein said cushioning stop (7) comprises further an empty pocket-like recess (10).

3. The vehicle door latch of claim 1 comprising further a second stop (12), said second stop (12) being disposed on the latch housing (4), and said second stop (12) limiting overtravel of said catch (2) when said catch (2) travels during a closing movement past said closed position.

4. The vehicle door latch of claim 1, wherein said cushioning element (8) is reinforced.

5. The vehicle door latch of claim 1, wherein said cushioning stop (7) is made from soundproofing material.

6. The vehicle door latch of claim 5, wherein said soundproofing material is made of polyurethane.

7. The vehicle door latch of claim 1, wherein said reset spring (1) is wound around an axis of rotation of said catch (2).

8. A vehicle door latch comprising:

a catch (2), said catch (2) having a main catch surface (21) extending horizontally; a pawl (3) cooperating with said catch (2);

a reset spring (1) for resetting said catch (2);

a cushioning stop (7) mounted on a partial section of the periphery of said catch (2) for rotation therewith; the cushioning stop having a cushioning side and non-cushioning side; the non-cushioning side for-providing a point of attachment for said reset spring (1); a cushioning element (8) for cushioning said catch (2); and a latch housing (4) having a receiving groove (13);

wherein said cushioning element (8) is disposed in said receiving groove (13);

said cushioning stop (7) is mounted on said main catch surface (21) and vertically projects over said main catch surface (21);

said cushioning element (8) vertically projects over said main catch surface (21) and partially-overlaps with said catch (2); and said cushioning stop (7) limits an opening movement of said catch (2) from a closed position to an open position by engaging against said cushioning element (8) and is directly connected to one end of said reset spring at the periphery of the catch at the attachment point.

9. The vehicle door latch of claim 8, wherein said cushioning stop (7) comprises further an empty pocket-like recess (10).

10. The vehicle door latch of claim 8 comprising further a second stop (12), said second stop (12) being disposed on the latch housing (4), and said second stop (12) limiting overtravel of said catch (2) when said catch (2) travels during a closing movement past said closed position.

11. The vehicle door latch of claim 8, wherein said cushioning element (8) is reinforced.

12. The vehicle door latch of claim 8, wherein said cushioning stop (7) is made from soundproofing material.

13. The vehicle door latch of claim 12, wherein said soundproofing material is made of polyurethane.

14. The vehicle door latch of claim 8, wherein another end of said reset spring (1) is wound around an axis of rotation of said catch (2).

15. A vehicle door latch comprising:

a catch (2), said catch (2) having a main catch surface (21) extending horizontally; a pawl (3) cooperating with said catch (2);

a reset spring (1) for resetting said catch (2);

a cushioning stop (7) mounted on a partial section of the periphery of said catch (2) for rotation therewith; the cushioning stop having a cushioning side and non-cushioning side; the non-cushioning side for-providing a point of attachment for said reset spring (1); a cushioning element (8) for cushioning said catch (2); and a latch housing (4) having a receiving groove (13);

wherein said cushioning element (8) is disposed in said receiving groove (13); said cushioning stop (7) is mounted on said main catch surface (21) and vertically projects over said main catch surface (21); said cushioning element (8) vertically projects agave over said main catch surface (21) and partially-overlaps with said catch (2); said cushioning stop (7) limits an opening movement of said catch (2) by engaging against said cushioning element (8) and is directly connected to one end of said reset spring at the periphery of the catch at the attachment point; and said catch (2) is shaped substantially as a disc (2) having a recess (61) for receiving a locking pin (6), and said cushioning stop (7) is mounted on said disc (2) substantially opposite said recess (61) with respect to said disc (2).

16. The vehicle door latch of claim 15, wherein said cushioning stop (7) comprises further an empty pocket-like recess (10).

17. The vehicle door latch of claim 15 comprising further a second stop (12), said second stop (12) being disposed on the latch housing (4), and said second stop (12) limiting overtravel of said catch (2) when said catch (2) travels during a closing movement past said closed position.

18. The vehicle door latch of claim 15, wherein said cushioning element (8) is reinforced.

19. The vehicle door latch of claim 15, wherein said cushioning stop (7) is made from soundproofing material.

20. The vehicle door latch of claim 15, wherein another end of said reset spring (1) is wound around an axis of rotation of said catch (2).

21. A vehicle door latch with at least one locking mechanism (2, 3) comprising:

a latch housing (4), having an inlet opening (5) for receiving a locking pin (6);

a cushioning element (8);

a catch (2) having a main catch surface (21) extending horizontally in said latch housing (4), a casing (9), and a periphery;

a cushioning stop (7);

a reset spring (1) for resetting said catch (2); and a pawl (3) cooperating with said catch (2);

wherein said cushioning element (8) is disposed on the latch housing (4) and is vertically offset on said latch housing (4) relative to said main catch surface (21);

said cushioning stop (7) is a stop rib disposed around a partial section of said periphery of the catch (2);

said cushioning stop (7) has a cushioning side (7*b*) and a non-cushioning side (7*a*);

said cushioning stop (7) limits an opening movement of said catch (2) by engaging in the opened position against said cushioning element (8);

said non-cushioning side (7*a*) forms a spring connection (11) for said reset spring (1); and one end of said reset spring (1) is directly connected to said spring connection (11) at the periphery of said catch (2).

22. The vehicle door latch of claim 21, wherein said cushioning stop (7) is encased with a soundproofing material.

23. The vehicle door latch of claim 21, wherein said pawl (3) is encased with a soundproofing material.

24. The vehicle door latch of claim 22, wherein said casing (9) comprises said cushioning stop (7).

25. The vehicle door latch of claim 22, wherein said cushioning stop (7) comprises further an empty pocket-like recess (10) forming a buffer.

* * * * *